United States Patent [19]

Dove, Jr.

[11] Patent Number: 4,674,453

[45] Date of Patent: Jun. 23, 1987

[54] ROCKER ARM AND METHOD OF FORMING THE SAME

[76] Inventor: James E. Dove, Jr., 1034 S. Reed Rd., Grafton, Ohio 44044

[21] Appl. No.: 820,367

[22] Filed: Jan. 21, 1986

[51] Int. Cl.[4] ..... F01L 1/18

[52] U.S. Cl. ..... 123/90.39; 74/519; 29/156.4 R

[58] Field of Search ..... 123/90.39, 90.41, 90.61; 74/519, 559; 29/156.4 R

[56] References Cited

U.S. PATENT DOCUMENTS

| | | | |
|---|---|---|---|
| 1,449,611 | 3/1923 | Konigslow | 123/90.39 |
| 1,515,201 | 11/1924 | Hewitt | 123/90.39 |
| 1,594,471 | 8/1926 | Short | 123/90.61 |
| 1,726,259 | 8/1929 | Daisley | 123/90.28 |
| 2,015,135 | 9/1935 | Brady | 123/90.39 |
| 2,749,890 | 6/1956 | Oldberg | 123/90.48 |
| 2,756,733 | 7/1956 | Meile | 123/90.48 |
| 2,882,878 | 4/1959 | Humphreys | 123/90.48 |
| 2,925,808 | 2/1960 | Baumann | 123/90.48 |
| 3,024,775 | 3/1962 | Wuest | 123/90.48 |
| 3,884,199 | 5/1975 | Irimajiri et al. | 123/90.48 |
| 4,182,290 | 1/1980 | Pohle | 74/519 |
| 4,430,969 | 2/1984 | Holtzberg et al. | 123/90.39 |
| 4,440,121 | 4/1984 | Clancy et al. | 123/90.39 |
| 4,617,883 | 10/1986 | Okuyama et al. | 123/90.39 |

FOREIGN PATENT DOCUMENTS

| | | | |
|---|---|---|---|
| 3150656 | 6/1983 | Fed. Rep. of Germany | 123/90.39 |

*Primary Examiner*—Ira S. Lazarus

*Attorney, Agent, or Firm*—Fay, Sharpe, Beall, Fagan, Minnich & McKee

[57] ABSTRACT

A rocker arm assembly for use in internal combustion engines comprising a rocker arm member having a longitudinal extent and including bearing means for mounting the member for oscillation about an axis perpendicular to its longitudinal extent. An insert body defining a push rod seat recess is press fitted in an end of the rocker arm member to extend transversely to the axis of oscillation. The insert has a first generally cylindrical end portion of a first diameter and a second axially aligned generally cylindrical end portion of a smaller diameter. The first end portion is spaced from the second end portion by an intermediate transition surface which is inclined relative to the axis of the cylindrical end portions. The push rod seat recess extends axially into the first end of the body. The relationship of the insert end portions and the transition surface prevents loosening of the insert in the rocker arm body.

20 Claims, 4 Drawing Figures

ROCKER ARM AND METHOD OF FORMING THE SAME

BACKGROUND OF THE INVENTION

The subject invention is directed toward the art of internal combustion engines and, more particularly, to an improved rocker arm assembly and method of making the same.

The invention is especially useful in high performance, high RPM engines of the type used in racing and will be described with particular reference thereto; however, it should be appreciated that the invention is useful in a variety of types of internal combustion engines used for many purposes.

High performance engines used in racing are subjected to extreme operating conditions including extended periods at top RPM's, sudden and rapid changes in loading, and the like. As is apparent, this results in extreme forces and changes in the forces applied to various engine components. Coupled with the inherent demands placed on the components has been the desire to increase performance and efficiency by reducing the size and weight of the individual components.

One component which has been especially vulnerable to failure has been the rocker arm members used to transmit movement from the cams to the engine intake and exhaust valves. These members are subjected to extremes in both dynamic and impact loading. A particularly vulnerable point has been the contact area between the push rod and the rocker arm, generally referred to as the push rod seat. Merely by way of example, when operated at peak RPM's, the push rod seat area may be subject to impact force variations of from 0 to 1500 pounds at 5000 times per minute. In addition, these forces may be applied over a 20 to 30 degree arcuate variation in direction relative to the seat area.

Attempts have been made to reduce the weight of rocker arms by forming their main body from light weight metal alloys, such as aluminum alloys, with the push rod seat area comprised of a hardened steel insert member interference fitted to the aluminum body. These attempts have not been especially successful. The constantly changing loads and their changing directions of application have caused fatigue in the aluminum body about the steel insert. As a result, the inserts have tended to loosen and "walk-out" of the rocker arm body.

BRIEF DESCRIPTION OF THE INVENTION

The subject invention provides a rocker arm assembly and method of making the same which overcomes the noted problems. Rocker arm assemblies formed in accordance with the invention are capable of withstanding the operating extremes encountered in high performance racing engines for extended periods of time without failing. In addition, the assemblies can be light in weight and are comparatively easy to manufacture.

In accordance with one aspect, the invention comprises a rocker arm assembly including a rocker arm member having a longitudinal extent and bearing means for mounting the member for oscillation about an axis which extends generally transversely of said longitudinal extent. An insert member, preferably formed from an extremely hard steel, is mounted in an opening formed adjacent an end of the rocker arm member. The insert comprises a body having a first generally cylindrical end portion with a diameter "D" and a length L and a second axially aligned generally cylindrical end portion of length "l" and diameter "d" which is less than "D". The first end portion is spaced from the second end portion by a transition surface which is inclined relative to the axis of the cylindrical end portions and a push rod seat recess extends axially into the first end of the insert body. The insert is mounted in an opening form adjacent an end of the rocker arm member with the axis of the first and second end portions being generally perpendicular to the axis of oscillation and the push rod seat recess facing outwardly.

In accordance with another limited aspect of the invention, the insert member is retained in the rocker arm member by an interference fit between the cylindrical end portions and the opening. Additionally, the opening in the rocker arm member preferably has a surface which closely engages the transition surface of the insert means.

In accordance with a more limited aspect of the invention, the insert member formed as described is press fitted into a correspondingly shaped opening in the rocker arm member. The press fitting is such that the two cylindrical end portions are engaged by the rocker arm member with a substantial interference fit and the transition surface is tightly engaged with the correspondingly shaped surface of the opening.

When rocker arm members are formed as described, the combination of the two interference fitted sections joined by an inclined transition surface firmly locks the push rod seat in the rocker arm and allows it to withstand substantial impact loading and loads applied at constantly varying angles. Preferably, the transition surface is angled in the range of 20° to 40° relative to the axis of the insert end portions. This produces a substantial surface area which lies generally perpendicular to the direction of force application by the push rod. When the insert member is shaped and mounted as described forces applied through the push rod are distributed more uniformly to the rocker arm member surrounding the insert and the likelihood of fatigue failure in the surrounding metal is greatly reduced.

Rocker arms formed in accordance with the subject invention have shown an effective life of substantially twice that of conventional prior assemblies. Loosening of the seat forming insert is seldom encountered and the resulting rocker assembly is extremely durable.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
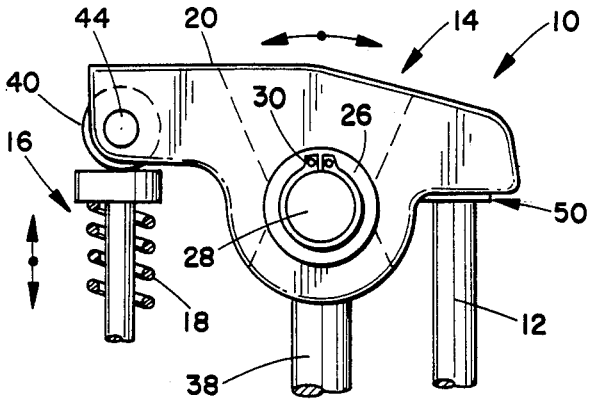
FIG. 1 is a partial elevational view of a combustion engine valve drive train showing a rocker arm formed in accordance with the subject invention.

Referring more particularly to the drawings wherein the showings are for the purpose of illustrating a preferred embodiment of the invention only and not for the purpose of limiting same, FIG. 1 shows the overall arrangement of a portion of a valve drive train including a push rod member 12 which extends upwardly from the camshaft and reciprocates vertically in properly timed relationship with the movement of the cylinders. The vertical reciprocation of the push rod 12 is conducted through the rocker arm assembly 14 to the valve operating stem assembly 15 which is suitably biased upwardly by a spring 18 which maintains the associated valve member (not shown) in a normally closed position until the forces applied through the rocker arm overcome bias of the spring and move the valve to an open position. The general arrangement thus far described forms no particular part of the invention and has been illustrated merely for the purpose of showing the general environment of the improved rocker arm assembly.

As discussed earlier, the rocker arm assembly may, at times, be subjected to extremely high dynamic and impact loading. This loading is particularly critical in the area of contact between the end of push rod and the rocker arm. This area is generally referred to as the push rod seat. The subject invention provides an arrangement whereby the rocker arm and its push rod seat can be formed of materials having substantially different physical properties and joined such that the forces encountered do not cause failure of either the seat or its connection to the rocker arm.

Figure 2:
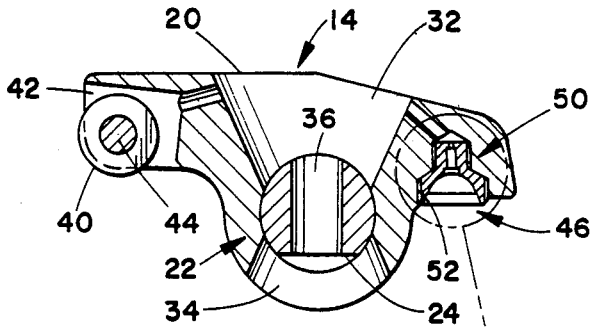
FIG. 2 is a longitudinal cross-sectional view through the rocker arm member of FIG. 1.

Referring in particular to FIGS. 1 and 2, the rocker arm assembly 14 is shown as comprising an elongated rocker arm member or body 20 which is formed from any suitable metal or alloy, although certain aluminum alloys are preferred. Extending generally transversely to the longitudinal extent of the rocker arm member is a bearing assembly 22 which includes a pair of spaced needle bearing members 24 and 26 which are press fitted into sides of the body 20. A mounting shaft 28 is retained in the bearings 24, 26 by suitable snap rings 30.

The rocker arm member 20 is provided with arcuately relieved cutouts 32, 34, respectively, located above and below the shaft 28 as best shown in FIG. 2. A transversely extending opening 36 is formed through shaft 28 and provides means by which the rocker arm assembly can be mounted on a vertical support shaft or stud 38 (see FIG. 1) extending upwardly from a subjacent engine component. The previously mentioned cutout or recessed portions 32, 34 permit free oscillation of the rocker arm assembly 14 relative to the support stud 38.

In the subject embodiment the motion of the rocker assembly 14 is transmitted to the valve stem 16 through a roller member 40 positioned in a recess 42 formed in the left-hand end of the rocker arm member 20 (as viewed in FIGS. 1 and 2). The roller 20 is suitably mounted for free rotation by a shaft or pin 44 carried in the rocker arm member 20.

Figure 3:
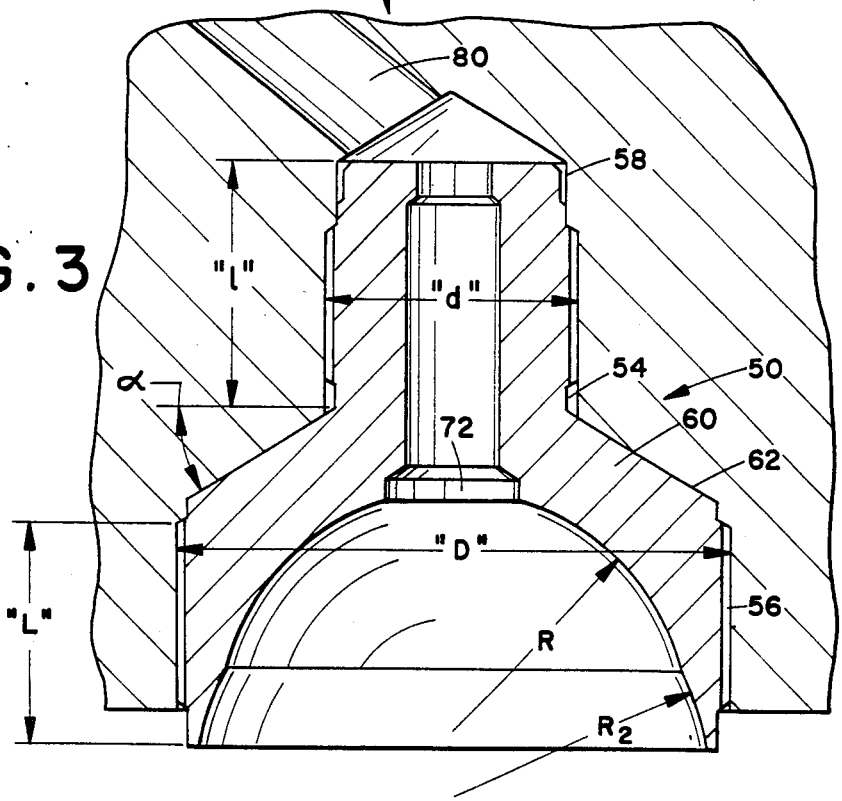
FIG. 3 is a greatly enlarged view of the circled area of FIG. 2.

Of particular importance to the subject invention is the push rod seat portion of the rocker assembly 14. As best shown in FIGS. 2 and 3, a push rod seat 46 is defined by an insert member 50 press fitted into a suitably shaped opening 52 formed in the right-hand end of the rocker arm member 20. As illustrated, the insert member 50 comprises an elongated body 54 having first and second end portions 56 and 58, respectively. The first end portion 56 has a generally cylindrical configuration having an outer diameter "D". The second end portion 58 is also cylindrical in configuration and axially aligned with end portion 56. End portion 58 has a diameter "d" which is preferably substantially less than the diameter "D" of end portion 56. In the specific embodiment under consideration "d" is approximately one-half of "D".

The end portions 56 and 58 are connected by an intermediate transition section 60 which has an outer surface 62. Surface 62 is preferably a surface of revolution about the axis of end portions 56, 58. In the embodiment under consideration, surface 62 is a truncated conical surface lying at an angle alpha relative to a plane perpendicular to axis A. Angle alpha could, of course, vary within certain limits. In the subject embodiment, however, angle alpha is preferably approximately 30° although it could vary in the range of generally from about 20° to approximately 40°.

Figure 4:
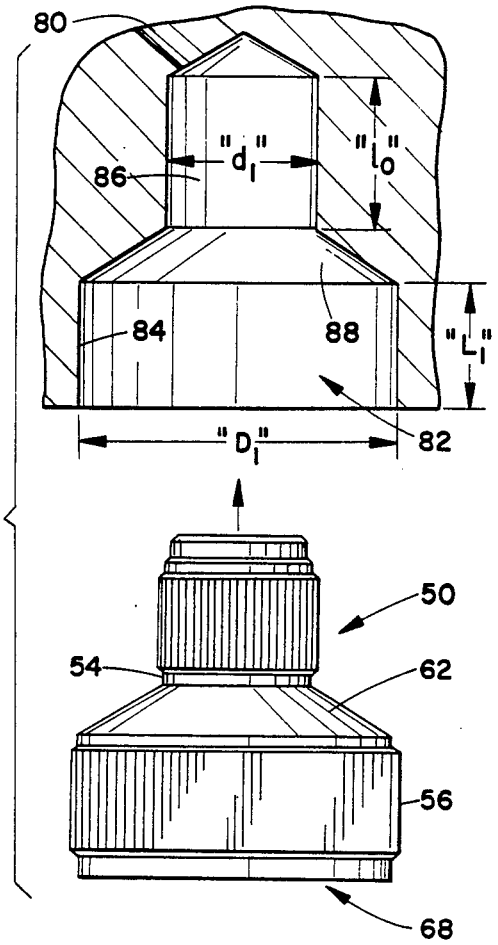
FIG. 4 is a view showing the push rod seat forming insert and the rocker arm opening into which it is fitted during assembly.

While the length of the end portions 56 and 58 (shown on the drawings as "L" and "l", respectively) could vary, they generally have a length substantially equal to the diameter of end portion 58. Also, as best shown in FIG. 4, the outer surfaces of end portions 56 and 58 are preferably provided with longitudinally extending striations over a significant portion of their axial length. In the embodiment under consideration the striations are produced by knurling the component during manufacture. The depth of the striations is approximately 0.010 to 0.015 inches.

A push rod receiving recess 68 is formed axially into the large diameter end portion 56 of the member 50. As shown, recess 68 includes a first portion of generally hemispherical configuration having a radius R. A corresponding radius formed on the upper end of push rod 12 is closely received within the recess 68. Formed about the inlet to recess 68 is a relief area 70 which preferably has a radius $R_2$ which is significantly larger than radius R. This provides clearance between the sides of push rod 12 and the entry to the recess and allows the necessary tilting movement to take place between the push rod and the rocker arm.

As shown in FIGS. 2 and 3, an axially exending opening 72 is formed through the small diameter end portion 58 and connects with the upper free end and recess 68. An opening 80 formed from the relieved area 32 of rocker arm body 20 permits oil to enter to a position above the upper end of member 50 and pass through opening 72 to provide lubrication between the end of the push rod and the inner wall of recess 68.

As discussed earlier, member 50 is press fitted into an opening formed in the right-hand end of rocker arm body 20. FIG. 4 shows the preferred arrangement for the opening 82 which receives the seat forming member 50. The opening includes a first portion 84 which has a diameter $D_1$ which is slightly less than the diameter D of member 50. The depth $L_1$ of the first portion is preferably substantially as great as the length L of the cylindrical end portion 56 of member 50. Axially aligned with the first portion 84 is a second inner portion 86 having a diameter $d_1$ which is also only slightly less than diameter d of member 50. The length $l_0$ of portion 86 is preferably at least as great as length l of portion 58 of member 50.

The relationship between the various diameters and the degree of interference can, of course, vary depending upon the materials, etc. In the subject embodiment there is preferably an interference of approximately 0.006 to 0.012 inches.

The two opening portions 84, 86 are connected by a transition section 88 which, preferably, has a size and shape so as to substantially exactly conform to the transition surface 62 of member 50.

With the recess 82 formed in the manner described the member 50 is inserted therein by application of a substantial force producing a press or interference fit between the components. The member 50 must be inserted sufficiently to bring the surface 62 into firm engagement with the wall of the transition section 88 of recess 82.

With the push rod seat formed and installed in the manner described, the seat can withstand substantial force and impact loading without shifting in the rocker arm body 20 to the surrounding aluminum body of the rocker arm. In addition, the transition surface between the two force or press fitted sections acts to continually force the insert toward the center of the opening and prevents substantial tilting forces from being applied directly to the knurled areas.

The invention has been described in great detail sufficient to enable one of ordinary skill in the art to make and use the same. Obviously, modifications and alterations of the preferred embodiment will occur to others upon a reading and understanding of the specification. It is my intention to include all such modifications and alterations as part of my invention insofar as they come within the scope of the appended claims.

Having thus described the invention, it is now claimed:

1. A method of forming a push rod seat in a rocker arm for an internal combustion engine comprising the steps of:

(a) providing a body having a first generally cylindrical end of diameter "D" and length "L" and a second axially aligned generally cylindrical end of length "l" and diameter "d" which is less than "D", said first end being spaced from said second end by an intermediate transition surface which is inclined relative to the axis of said first and second ends;

(b) forming a push rod seat recess axially into said first end of said body;

(c) providing a rocker arm;

(d) forming an opening adjacent an end of said rocker arm, said opening having a cylindrical inner end of a diameter $d_1$, which is slightly less than d and a length $l_1$ which is at least as great as l, and an outer end of said opening having a diameter D, which is slightly less than D; the inner and outer ends of said opening being joined by a transition surface which generally corresponds to the transition surface of said body; and, (e) press fitting said body into said opening.

2. The method as defined in claim 1 wherein said transition surface is formed to have a generally truncated conical shape.

3. The method as defined in claim 1 wherein the cylindrical end portions of said body are formed with axial knurling.

4. The method as defined in claim 1 wherein said body is formed from a material significantly harder than said rocker arm.

5. The method as defined in claim 1 wherein said opening in said rocker arm is formed to have a length L which is approximately equal to L.

6. An article of manufacture for press fitting into a rocker arm of an internal combustion engine for providing a push rod seat, said article comprising: an elongated body formed of metal and having a first cylindrical end portion of diameter "D" and length "L" and a second axially aligned cylindrical end portion of length "l" and diameter "d" which is less than D, a transition surface joining said first and second end portions and inclined relative to the axes of said end portions, and a recess formed axially into the first end portion of said body.

7. The article as defined in claim 6 wherein said transition surface is generally in the shape of a truncated cone.

8. The article as defined in claim 6 wherein at least portions of the outer surfaces of said first and second end portions are provided with axially extending striations.

9. The article as defined in claim 6 wherein said recess is a surface of revolution formed by a curvilinear line.

10. The article as defined in claim 6 wherein said recess is hemispherical in configuration.

11. The article as defined in claim 8 including a circumferential recess formed at the juncture between said first end portion and said transition surface.

12. The article as defined in claim 11 including an opening extending axially from said recess to said second end portion.

13. The article as defined in claim 12 wherein diameter D is approximately twice diameter d.

14. The article as defined in claim 7 wherein said transition surface makes an angle of approximately 30° with a plane perpendicular to said axes.

15. A rocker arm assembly for use in internal combustion engines comprising:

(a) a rocker arm member having a longitudinal extent and including bearing means for mounting said member for oscillation about an axis which extends generally transversely of said longitudinal extent;

(b) an insert means comprising a body having a first generally cylindrical end portion with a diameter "D" and a length L and a second axially aligned generally cylindrical end portion of length "l" and diameter "d" which is less than "D", said first end portion being spaced from said second end portion by an intermediate transition surface which is inclined relative to the axis of said cylindrical end portions, a push rod seat recess extending axially into said first end of said body.

(c) said insert means mounted in an opening formed adjacent an end of said rocker arm member with the axis of said first and second end portions being generally perpendicular to the axis of oscillation and the push rod seat recess facing outwardly.

16. The assembly as defined in claim 15 wherein "D" is approximately twice as large as "d".

17. The assembly as defined in claim 15 wherein said insert means is retained in said rocker arm member by an interference fit between the cylindrical end portions and said opening.

18. The assembly as defined in claim 17 wherein said opening includes a surface closely engaging the transition surface of said insert means.

19. The assembly as defined in claim 18 wherein the cylindrical end portions of said insert body have striations formed on their exterior.

20. The assembly as defined in claim 19 wherein said transition surface is a truncated conical surface and makes an angle in the range of 20° to 40° relative to a plane extending perpendicular to the axis of said cylindrical portions.

* * * * *